US005257944A

United States Patent [19]

Kennedy

[11] Patent Number: 5,257,944

[45] Date of Patent: Nov. 2, 1993

[54] CONNECTOR POSITION ASSURANCE ASSEMBLY

[75] Inventor: Robert D. Kennedy, Northville, Mich.

[73] Assignee: Interlock Corporation, Westland, Mich.

[21] Appl. No.: 948,584

[22] Filed: Sep. 23, 1992

Related U.S. Application Data

[63] Continuation-in-part of Ser. No. 913,164, Jul. 14, 1992.

[51] Int. Cl.[5] ..... H01R 4/50

[52] U.S. Cl. ..... 439/347; 439/489

[58] Field of Search ..... 439/345, 350, 352, 357, 439/358, 347, 488, 489

[56] References Cited

U.S. PATENT DOCUMENTS 4,746,306 5/1988 Yurtin et al. .

4,950,179 8/1990 Takenouchi et al. ..... 439/352

4,993,967 2/1991 Matsumoto .

5,026,298 6/1991 Brussalis et al. .

5,127,847 7/1992 Kato et al. .

*Primary Examiner*—Larry I. Schwartz

*Assistant Examiner*—Khiem Nguyen

*Attorney, Agent, or Firm*—Harness, Dickey & Pierce

[57] ABSTRACT

An assembly assuring proper engagement or mated electrical connectors. The assembly includes a pair of connectors which are configured for creating electrical contact between terminals housed therein. A connector position assurance member is retainingly engaged with one of the connectors in a preassembled position. If the connectors are properly engaged, the CPA member is capable of being moved from its preassembled position to a second or home position. If the connectors are improperly engaged, movement of the CPA member from its preassembled position to its home position is prohibited thereby positively indicating that an improper engagement between the connectors exists.

13 Claims, 4 Drawing Sheets

CONNECTOR POSITION ASSURANCE ASSEMBLY

CROSS REFERENCE TO RELATED APPLICATION

This application is a continuation-in-part of U.S. patent application Ser. No. 07/913,164, filed on Jul. 14, 1992.

BACKGROUND AND SUMMARY OF THE INVENTION

This invention relates generally to electrical connectors and more particularly to an assembly for assuring proper positioning and engagement of mated electrical connectors.

In developing electrical connector systems, it is desirable to incorporate features which, either visually or physically, assure that mated electrical connectors have been fully and properly engaged during the assembly procedures. These features have commonly become known as connector position assurance (CPA) members. In the end products with which they are used, the CPA members allow for increased production rates and greater quality control by more readily permitting inspection of the electrical connectors for proper connection. As used herein, the terms "fully and properly engaged" are intended to mean that the electrical terminals housed within the mated electrical connectors have been engaged with sufficient electrical contact between them to achieve their intended purpose.

Typically, the CPA members are manually inserted into the electrical connectors after the connectors have been assembled together. If the CPA member can be inserted into the assembled electrical connectors, it is an indication that the electrical connectors have been properly engaged. If the CPA member cannot be inserted into the assembled electrical connectors, it is an indication that the electrical connectors are not properly engaged.

One disadvantage of the prior art is that these previous CPA members do not readily lend themselves to automated use. Since the prior CPA members were manually inserted into the assembled electrical connectors, the operator was required to physically carry or cart a supply of the CPA members when ascertaining whether or not the electrical connectors have been properly assembled. Often the CPA members were dropped and/or lost thereby increasing production time and costs.

In view of the above and other limitations, it is an object of the present invention to provide for an electrical connector assembly having a CPA member which cooperates with a pair of electrical connectors to assure that the electrical connectors have been fully and properly engaged with one another.

It is another object of this invention to provide for an assembly having a CPA member which will provide both physical and visual assurances that the electrical connectors have been fully and properly engaged together.

It is a further object of this invention to provide for an assembly having a CPA member which may be preassembled with one of the electrical connectors prior to the electrical connectors being engaged together. Once preassembled, inadvertent removal of the CPA member is prevented.

Still another object of this invention is to provide a connector position assurance assembly having a CPA member which, upon proper engagement of the pair of electrical connectors, may be moved from its preassembled position into a second or home position thereby indicating that the electrical connectors have been fully and properly assembled. If the pair of electrical connectors are improperly assembled, the CPA member will remain in its preassembled position as movement into the home position will be prohibited.

In achieving the above objects, the present invention provides an electrical connector position assurance assembly in which a first electrical connector, is configured for mated connection with a second electrical connector. The CPA member is mounted in a first or preassembled position with a portion of the first electrical connector prior to the engagement of the first and second electrical connectors.

In its preassembled position, the CPA member is prevented from being inadvertently removed or moved into a second or home position. Only if the first and second electrical connectors have been properly assembled together can the CPA member be moved from its preassembled position into its home position.

Upon assembly of the connectors, a portion of the second electrical connector operates to disable a stop member, which has been prohibiting movement, and thereby permits movement of the CPA member into its home position indicating that the electrical connectors are properly and fully connected.

The CPA member utilized in the present invention is readily mounted into its preassembled position through automated assembly procedures and cannot inadvertently become dislodged or removed. To this end, the CPA member of the present invention includes a positive retention mechanism. Furthermore, the assembling of the first and second electrical connectors can be achieved by automated procedures and movement of the CPA member, from its preassembled position into its home position, can be performed by appropriate mechanisms or, if desired, can be performed by an operator manually actuating the CPA member to see if movement occurs.

If service of the electrical connectors is required, the deliberate removal of the CPA member and disconnecting of the electrical connectors is easily performed.

Additional benefits and advantages of the present invention will become apparent to those skilled in the art to which this invention relate from the subsequent description of the preferred embodiments and the appended claims, taken in conjunction with the accompanying drawings.

DETAILED DESCRIPTION OF THE PREFERRED EMBODIMENT

Figure 1:
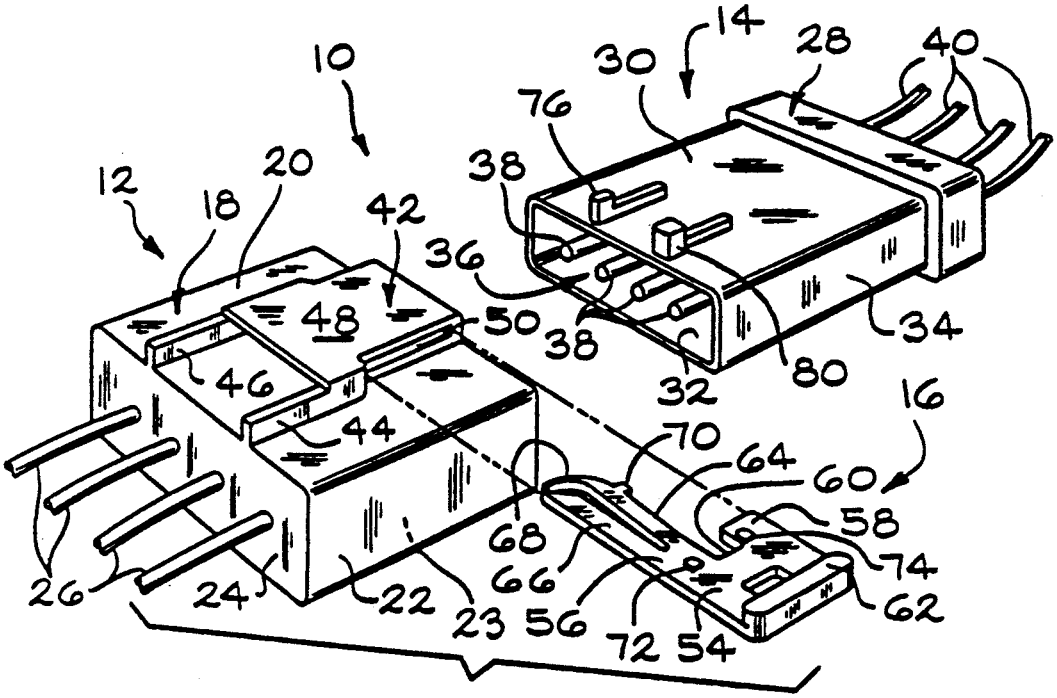
FIG. 1 is a perspective view of an unassembled connector position assurance assembly embodying the principles of the present invention.
Figure 2:
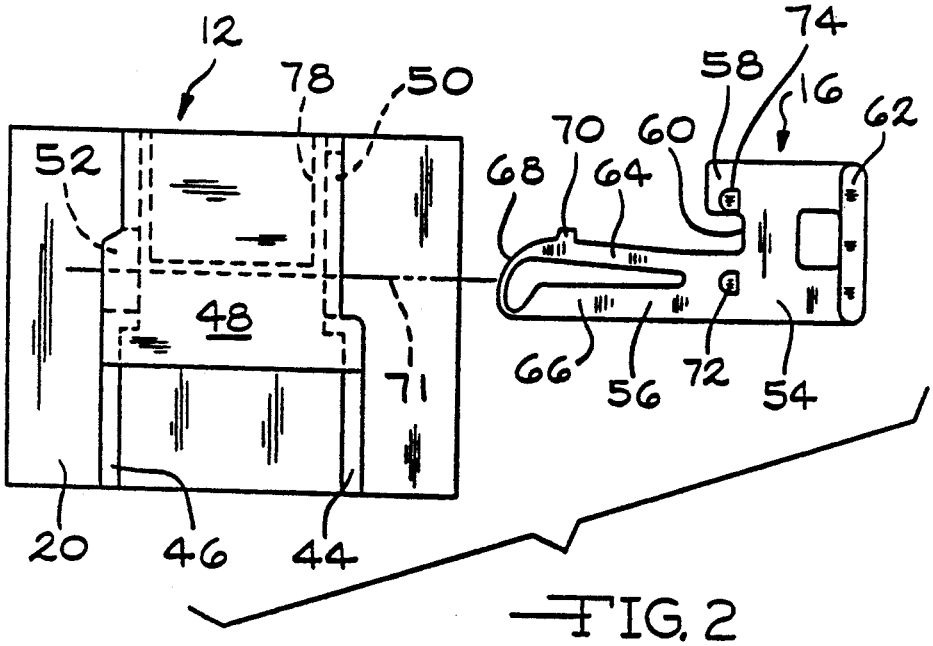
FIG. 2 is plan view showing the insertion axis of the CPA member relative to one of the electrical connectors.

Now with reference to the drawing, a first embodiment of a connector position assurance assembly incorporating the principles of the present invention is generally illustrated in FIG. 1 and designated at 10. The primary components of the present assembly 10 include a pair of electrical connectors 12 and 14 and a connector position assurance (CPA) member 16.

The electrical connector 12 (hereinafter the female connector 12) includes a housing 18 which defines a cavity 19 for enclosing at least one, and preferably more than one, electrical terminal (not shown). As such, the housing 18 of the female connector 12 includes a top wall 20, sidewalls 22, a bottom wall 23 and an end wall 24. The cavity 19 is open on an end opposite of the end wall 24. The terminals are secured within the housing 18 by conventional methods and leads 26, connected to the terminals, extend through the end wall 24 of the housing 18 to the component with which the female connector 12 is being used.

The mating electrical connector 14, hereinafter the male connector 14, likewise includes a housing 28 having a top wall 30, a bottom wall 32, sidewalls 34, and an end wall 35. Thus, the housing 28 of the male connector 14 also defines a cavity 36 which is open at one end 36 and which encloses electrical terminals 38. The terminals 38 are conventionally secured within the housing 28 and are connected to leads 40 that extend through the end wall 35 of the male connector 14.

As readily seen in FIG. 1, the female and male connectors 12 and 14 are configured for mated engagement with one another. Similarly, the terminals within the female connector 12 are configured to engage and make electrical contact with the terminals 38 of the male connector 14.

Formed on the top wall 20 of the female connector 12 is a raised receiver 42. The receiver 42 includes a pair of opposing walls 44 and 46 which extend upward from the top wall 20 of the housing 18. A transverse wall 4 extends between the upright walls 44 and 46. Formed in the upright walls 44 and 46, substantially opposite from one another, are first and second slots 50 and 52 into which the CPA member 16 is received. While other positioning is possible, it is preferred that the slots 50 and 52 are formed in the upright walls 44 and 46 generally adjacent to the open end of the female connector 12. As will be more fully appreciated from the discussion set out below, the first slot 50 is somewhat greater in its length than the second slot 52.

The CPA member 16 includes a main body portion 54 having primary and secondary extensions 56 and 58 which extend off to one side thereof. A recessed portion 60 is formed between the extensions 56 and 58. On the opposing side of the main body 54 is a transverse rib 62 which provides a gripping surface on the CPA member 16 for when it is being manually handled by an operator.

The primary extension 56 of the CPA member 16 includes a pair of diverging scissor-like legs, hereinafter upper and lower legs 64 and 66, which are connected together at their outermost ends by an integral resilient loop portion 68. The legs 64 and 66 are inherently formed so as to be resiliently biased apart. The loop portion 68 provides an additional means for biasing the legs 64 and 66 apart. As seen the figures, the width of the lower leg 66 is greater than that of the upper leg 64.

While the illustrated embodiment is shown with the legs 64 and 66 connected together at their outermost ends, in an alternative embodiment the legs 64 and 66 could be separate and independent of one another without impacting the operability of the CPA member 16. This additional embodiment is further set out below.

Formed outboard of the main body portion 54 on the upper leg 64, adjacent to the loop portion 68, is a stop tooth 70. The stop tooth 70 is formed so as to extend transversely off of the upper leg 64 in a direction away from the lower leg 66 and an insertion axis 71. For reasons which will become apparent, the distance which the stop shoulder 70 extends from the upper leg 64 is less than the distance immediately between the upper and lower legs 64 and 66.

Figures 3, 4, 5:
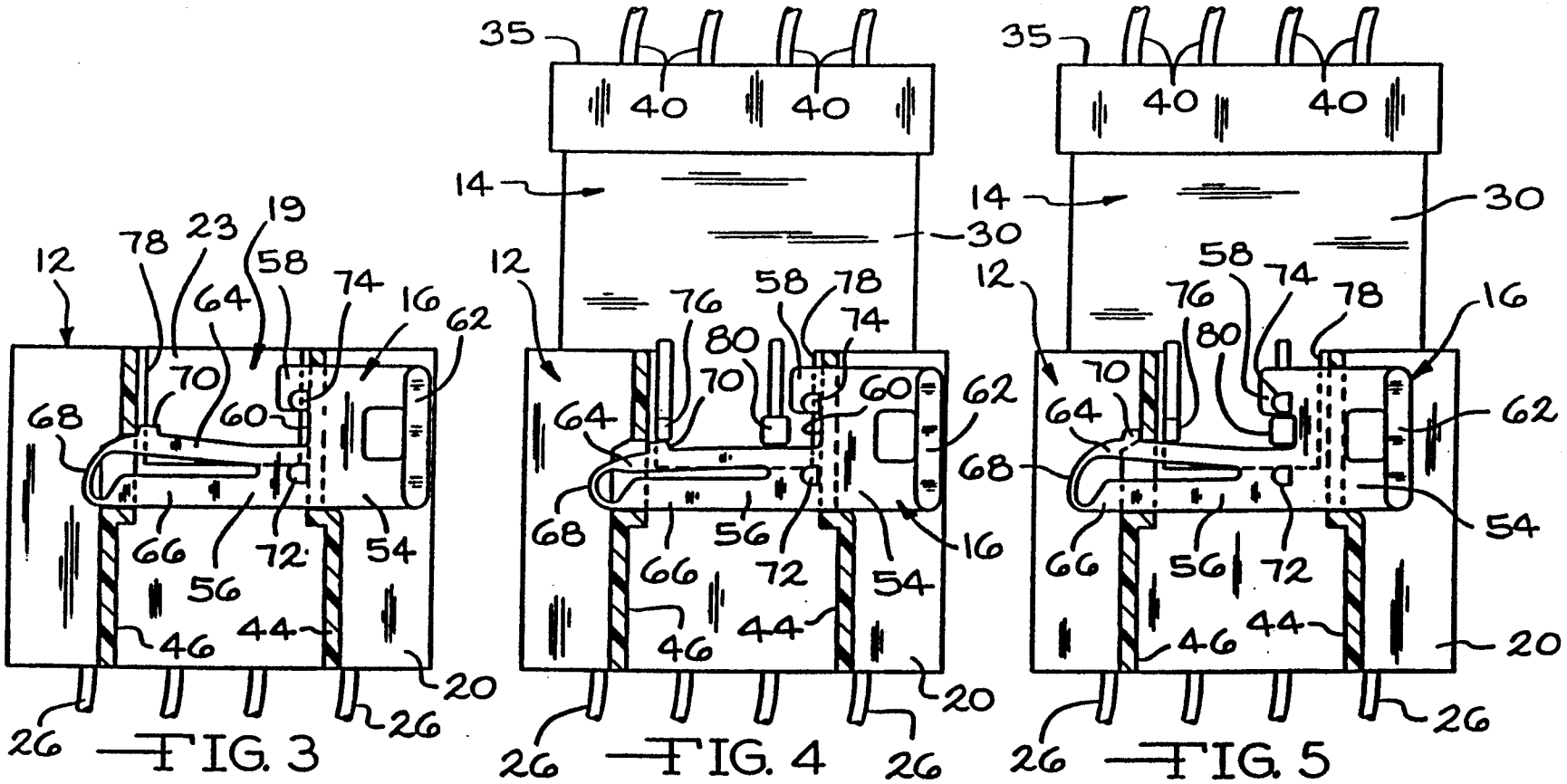
FIG. 3 is plan view with portions broken away showing the CPA member preassembled with one of the electrical connectors.
FIG. 4 is a plan view with portions broken away illustrating the electrical connectors being fully assembled together and the relative position of the CPA.
FIG. 5 is a plan view substantially similar to FIG. 3 illustrating the CPA member in its home position.

In mounting the CPA member 16 to the female connector 12, the loop portion 68 is directed along the insertion axis 71 into the first slot 50 and through the receiver 42 into the second slot 52. The length of the second slot 52 is dimensioned to substantially correspond with the width of the loop portion 68. The first slot 50 is dimensioned to correspond with and to receive the main body portion 54 of the CPA member 16. As seen in FIG. 3, when the CPA member 16 has been inserted into the receptacle 42, the stop shoulder 70 will engage a portion of the upright wall 46 and will prevent further insertion of the CPA member 16. This is the preassembled position of the CPA member 16.

A pair of shoulders or detents 72 and 74 extend upward from the primary body portion 54 to resist withdrawal of the CPA member 16. The detents 72 and 74 may include ramped upper surfaces to assist in their passage through the first slot 50. When inserted, the CPA member 16 is "locked" into its preassembly position. Thus, the CPA member 16 is prevented from being inadvertently withdrawn from the receptacle 42 by interfering engagement of the detents 72 and 74 with an interior portion of the wall 44 adjacent to the first slot 50. The CPA member 16 is prevented from being further inserted along the axis 7 into the receiver 42 by the interfering engagement of the stop tooth 70 with an interior portion of the wall 46 adjacent to the second slot 52. With the CPA member 16 securely held in its preassembled position, the female connector 12 can be readily manipulated for additional and subsequent assembly procedures without fear that the CPA member 16 will become inadvertently dislodged and/or lost.

As mentioned above, the configuration of the male connector 14 allows for mated engagement with the female connector 12. If the connectors 12 and 14 are fully and properly mated, electrical contact will be made between the male terminals 38 and the terminals of the female connector 12.

As seen in FIG. 4, when the male connector 14 is fully and properly engaged with the female connector 12, a raised portion or cam 76, extending upward from the top wall 30 of the male connector 14, will engage the stop tooth 70 and deflect the upper leg 64 toward the lower leg 66. The lower leg 66 will not deflect because it is in contact with a portion of the wall 46 that defines the second slot 52. To permit the cam 76 to engage the stop tooth 70, a slot 78 is defined in the top wall 20 of the female connector 12. This slot 78 is positioned substantially beneath the transverse wall 48 of the receiver 42. When the male connector 14 is fully and properly engaged with the female connector 12, the upper leg 64 will be compressed or deflected toward the lower leg 66 by an amount sufficient to disengage the stop tooth 70 from the upright wall 46. Alternatively, the cam 76 could engage the upper leg 64 instead of the stop tooth 70.

Movement of the CPA member 16 into its home position is now permitted because, with the upper leg 64 deflected, the stop tooth 70 is able to pass through the slot 52. After the stop tooth 70 has passed through the slot 52, the upper and lower legs 64 and 66 return to their outwardly biased positions. Withdrawal of the CPA member 16 from the receiver 42 is now inhibited by interfering engagement between the stop tooth 70 and the exterior surface of the upright wall 46.

To prevent over insertion of the CPA member 16 through the receiver 42, a boss or raised projection 80 is also formed in the top wall 30 of the male connector 14. The positioning of the boss 80 on the top wall 30 is such that when the connectors 12 and 14 are properly engaged and the CPA member 16 is moved into its home position, the boss 80 is received in the recessed portion 6 of the CPA member 16 which obstructs further insertion.

If desired, the CPA member 16 may be removed and the electrical connectors 12 and 14 disconnected for servicing. This is easily done by manually compressing the upper and lower legs 64 and 66 together, thereby disengaging the stop tooth 70 and allowing for withdrawal of the CPA member 16.

Figure 6:
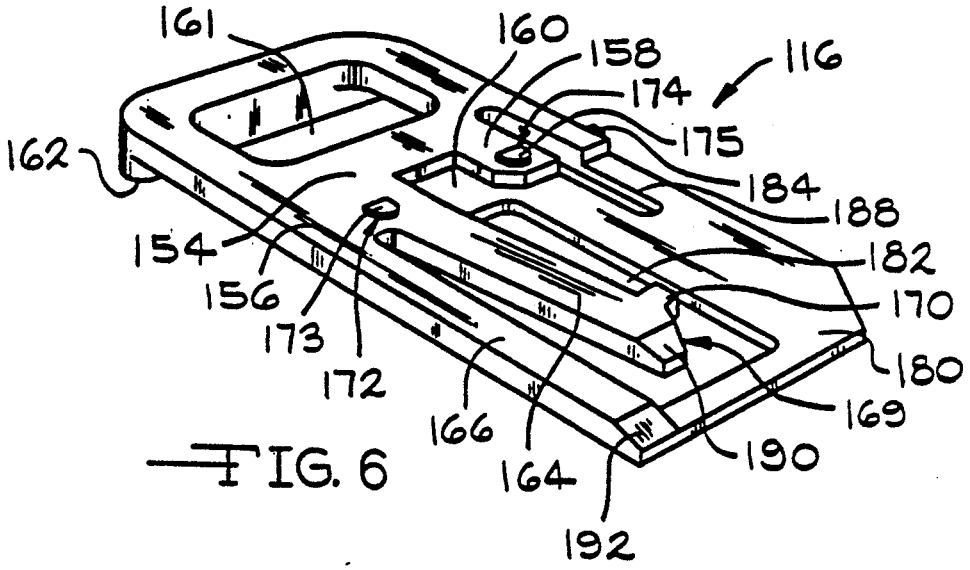
FIG. 6 is a perspective view of another embodiment of a CPA member embodying the principles of the invention.
Figure 7:
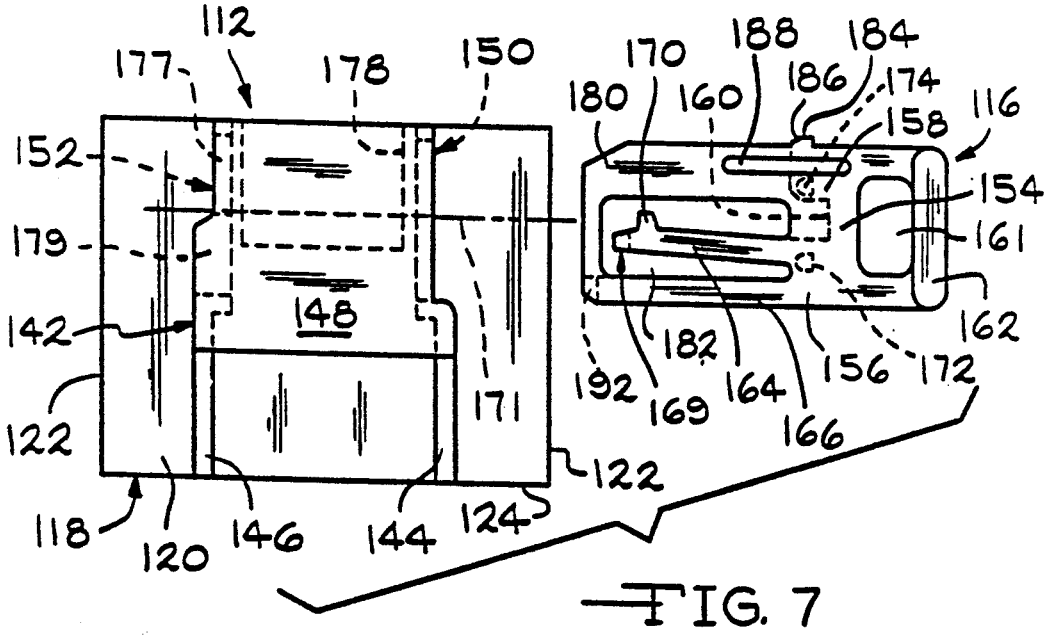
FIG. 7 is a plan view similar to FIG. 2 showing the insertion axis of the second embodiment of the CPA member relative to one of the electrical connectors.
Figure 8:
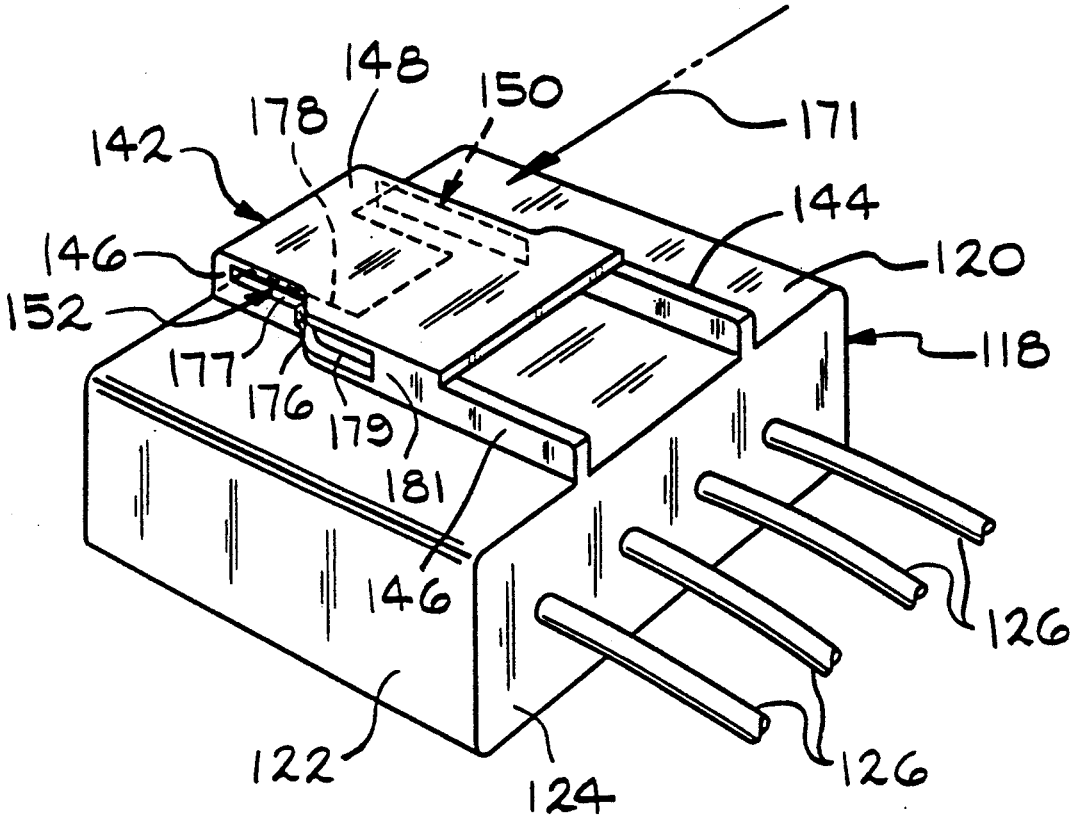
FIG. 8 is a perspective view of a female electrical connector according to a second embodiment of the present invention.

A second embodiment of the present invention is illustrated in FIGS. 6, 7 and 8. A CPA member 116 according to the second embodiment includes a main body 154 having primary and secondary extensions 156 and 158, which laterally extend off to one side of the main body 154. A recessed portion 160 is formed between the extensions 156 and 158 and a transverse rib 162 is formed along an edge of the main body 154, generally opposite the primary and secondary extensions 156 and 158. The rib 162 provides a gripping structure on the CPA member 116 to increase the ease with which it is manually manipulated by an operator. An opening 161 is defined through the main body portion 154 substantially adjacent the transverse rib 162. This opening 161 decreases the amount of material required to form the CPA member 116 without inhibiting its performance.

The primary extension 156 of the CPA member 116 diverges into two integrally formed scissor-like legs, hereinafter referred to as upper and lower legs 164 and 166. The upper leg 164 extends into an opening 182 defined by a rigidifying frame 180, which is further discussed below, and is resiliently biased apart from the lower leg 166 A stop tooth 170 is formed on an outboard or free end 169 of the upper leg 164 and extends generally transversely from the longitudinal axis of the upper leg 164 away from the lower leg 166. As used herein, "free" is intended to mean that the end 169 is not further attached to additional structure of the CPA member 116.

A female electrical connector 112, adapted for use with the CPA member 116 of this embodiment, is illustrated in FIGS. 7 and 8. As with the previously discussed embodiment, the female electrical connector 112 is configured for mated engagement with a male electrical connector (not shown). It should be understood that the male electrical connector is substantially similar to that shown in FIGS. 1, 4 and 5 and previously discussed above.

The female electrical connector 112 includes a housing 118 having a top wall 120, side walls 122, a bottom wall (not designated), and an end wall 124 which cooperate to define a cavity enclosing at least one electrical terminal (not shown) connected to a lead 126. Integrally formed or mounted on the top wall 120 of the female electrical connector 112 is a raised receiver 142.

The receiver 142 is defined by a pair of opposing walls 144 and 146, extending upward from the top wall 120 of the housing 118, and a transverse wall 148 which extends between the upright walls 144 and 146. Formed in each of the walls 144 and 146, substantially opposite from one another, are first and second slots 150 and 152 into which the CPA member 116 is received. While other positioning could be utilized, it is preferred that the slots 150 and 152 are formed in the upright walls 144 and 146 generally adjacent to the open end of the female connector 112.

Both of the slots 150 and 152 are shaped to substantially correspond to the thickness of the CPA member 116, at the respective portion which will be extended therethrough. Accordingly, the first slot 150 has a width which substantially corresponds with the thickness of the CPA member 116 at the main body portion 154. The configuration of the second slot 152 is varied such that its width substantially corresponds with the thickness variations near the distal end of the CPA member 116.

Referring now to FIG. 6, the main body 154 of the CPA member 116, along with the primary and secondary extensions 156 and 158, is formed with a uniform thickness. Integrally formed with the CPA member 116 is the rigidifying frame 180 mentioned earlier. The frame 180 extends generally axially from the secondary extension 158 and then transversely toward the outboard end of the lower leg 166. While structurally strengthening the CPA member 116, the frame 180 also serves as a guard to prevent inadvertent damage to the upper leg 164. As seen in FIG. 6, the frame 180 has a thickness which is less than that of the main body 154 and the primary and secondary extensions 156 and 158.

For reasons which will become apparent from the discussion which follows, one portion, generally designated at 179, of the slot 152 exhibits a width sufficient to receive the thicker upper and lower legs 164 and 166 while another portion, designated at 177, exhibits a reduced width and therefore can only accept the rigidifying frame 180 of the CPA member 116 thereinto.

When inserting the CPA member 116 into its preassembled position within the female electrical connector 112, the outboard or distal end of the CPA member 116, opposite from the transverse rib 162, is directed along the insertion axis 171 into the first slot 150, through the receiver 142 and into the second slot 152. However, as the CPA member 116 is inserted, a step or shoulder 176, defining the transition of the second slot 152 into its reduced width portion 177, will interferingly engage the stop shoulder 170 and prevent further insertion of the CPA member 116. This position of the CPA member 116 is referred to as the preassembled position.

To resist and prevent inadvertent removal of the CPA member from its preassembled position, a pair of shoulders or detents 172 and 174 are formed on the upper surface of the main body portion 154. The detents 172 and 174 are provided with ramped surfaces 173 and 175 which assist in their passage through the first slot 150. When inserted, the CPA member 116 is "locked" into its preassembled position since the detents 172 and 174 interferingly engage an interior portion of the wall 144 if withdrawal is attempted. With the CPA member 116 securely held in its preassembled position, the female electrical connector 112 can be readily manipulated for additional and subsequent assembly procedures.

As stated above with reference with the first embodiment, the configuration of the male connector allows for its engagement with the female electrical connector 112. When the male connector is engaged with the female connector 112, a raised projection or cam (similar to cam 76) will engage the stop tooth 170 or the upper leg 164 causing the upper leg 164 to deflect toward the lower leg 166. The lower leg 166 will not deflect because it is in contact with a portion 181 of the wall 146 defining the second slot 152. Continued insertion of the male connector will cause the upper leg 164 to deflect toward the lower leg 166, generally into the increased width portion 179 of the slot 152. Full and proper insertion of the male connector will cause the upper leg 164 to deflect in an amount sufficient to disengage the stop tooth 170 from the shoulder 176. A slot 178, defined in the top wall 120 of the female connector 112, permits engagement between the cam and the stop tooth 170 or upper leg 164.

With the stop tooth 170 disengaged from the shoulder 176 of the upright wall 146, the CPA member 116 can be further inserted into its "home" position. After the stop tooth 170 has passed through the slot 152, the upper leg 164 will return to its original, undeflected position and will prevent withdrawal of the CPA member 116 from the receiver 142 because of the interference engagement between the stop tooth 170 and the exterior surface of the upright wall 146 in the area of the shoulder 176.

Also as discussed in connection with the previous embodiment, when the female connector 112 is properly engaged with the male connector, a boss or raised projection, formed on the top wall of the male connector, will be positioned to obstruct and prevent over insertion of the CPA member 116 through the receiver 142. The boss of the present embodiment is positioned to interferingly engage the secondary extension 158 and prevent over insertion. Other positionings, such as with the recess 160, are also possible. If the boss is provided to engage the recess 160, the present invention can be adapted to prevent inadvertent separation of the male and female connectors 112 because of the interfering location of the secondary extension 158 relative to the boss of the male connector.

If desired, the CPA member 116 can be removed and the male and female electrical connectors 112 can be disengaged for servicing or inspection. This is easily done by deflecting the upper leg 164 toward the lower leg 156, thereby disengaging the stop tooth 170 into the increased width portion 179 of the second slot 152, gripping the transverse rib 162, and pulling on the CPA member 116 with sufficient force to cause the detents 172 and 174 to disengage from the respective portions of the upright wall 144.

To further ensure that the CPA member 116 is not inadvertently removed from the female electrical connector 112, a retaining shoulder 184 is provided on and extends transversely from the secondary extension 158 of the CPA member 116. If withdraw of the CPA member 116 is attempted, the retaining shoulder 184 will prohibitively engage a portion of the upright wall 144. A ramped lead-in surface 186 is provided on the retaining shoulder 184 to aid during insertion of the CPA member 116 into the receiver 142. Also, a slot 188 is defined in the CPA member 116 immediately adjacent to the retaining shoulder 184. The slot 188 permits deflection and disengagement of the retaining shoulder 184 when it is desirable to remove the CPA member 116 from the female electrical connector 112.

To assist during introduction of the CPA member 116 into the raised receiver 142 of the female electrical connector 112, ramped surfaces 190 and 192 are respectively provided on the distal end 169 of the upper leg 164 and the lower leg 166.

The above description of the preferred embodiment is intended only to be illustrated of the various aspects of the present invention and is not intended to limit the invention to the precise form disclosed. Thus, it is understood that connector position assurance assemblies having CPA members which are mounted in a first preassembled position and movable to a second home position, upon the proper engagement of two electrical connectors, are believed to be within the purview of this invention.

While the above description constitutes the preferred embodiment of the present invention, it will be appreciated that the invention is susceptible to modification, variation, and change without departing from the proper scope and fair meaning of the accompanying claims.

What is claimed is:

1. A connector assembly for assuring proper engagement of electrical connectors, said assembly comprising:

a first connector including a housing having at least one electrical terminal mounted therein, a second connector also including a housing and having at least one electrical terminal mounted therein, said first and second connectors configured for mated engagement generally along an axis with one another for establishing electrical contact between said electrical terminals;

a connector position assurance (CPA) member movable into a preassembled position relative to said first connector prior to engagement of said first and second connectors, said CPA member being transversely movable with respect to said axis from said preassembled position into a second position relative to said first connector upon proper engagement of said first and second connectors, said CPA member including a main body having a resilient leg extending therefrom, said resilient leg including a first, fixed end formed with said main body and a second end positioned outboard of said main body, said resilient leg having formed thereon means for preventing movement of said CPA member from said preassembled position into said second position until after proper engagement of said first and second connectors thereby assuring establishment of electrical contact between said electrical terminals of said first and second connectors;

means formed on said first connector for receiving said CPA member in said preassembled position and said second position; and means for disabling said preventing means upon proper engagement of said first and second connectors and permitting movement of said CPA member from preassembled position into said second position.

2. A connector assembly according to claim 1 wherein said receiving means includes a housing having upright walls, said upright walls cooperating to at least partially define a receiving space therebetween into which said CPA member is received.

3. A connector assembly according to claim 2 wherein at least one of said upright walls includes portions defining a slot, said CPA member being received in said slot into said preassembled position.

4. A connector assembly according to claim 3 wherein said upright wall portion defining said slot includes a portion defining a step cooperating with said preventing means to prevent movement of said CPA member from said preassembled position into said second position.

5. A connector assembly according to claim 4 wherein said slot includes first and second width sections exhibiting different widths, said step defining a transition between said first and second width sections.

6. A connector assembly according to claim 1 wherein said receiving means includes two opposing upright walls, said opposing upright walls each including portions defining a slot therein, said CPA member being received in said preassembled position in said slot of each of said opposing upright walls.

7. A connector assembly according to claim 1 wherein said preventing means includes a shoulder formed on said resilient leg, said shoulder interferingly engaging a portion of said first connector to prevent movement of said CPA member from said preassembled position to said second position.

8. A connector assembly according to claim 7 wherein said shoulder is located substantially adjacent said second end of said resilient leg.

9. A connector assembly according to claim 1 wherein said second end of said resilient leg is free.

10. A connector assembly according to claim 13 wherein a positive retaining shoulder is provided on said CPA member preventing withdrawal of said CPA member from said preassembled position, said retaining shoulder being positioned for interfering engagement with a portion of said first connector to prevent withdrawal of said CPA member from said preassembled position.

11. A connector assembly according to claim 10 wherein a slot is defined in said CPA member adjacent said retaining shoulder, said slot allowing said retaining shoulder to be deflected to a non-interfering position permitting withdrawal of said CPA member from said first connector.

12. A connector assembly for assuring proper engagement of electrical connectors, said assembly comprising:

a first connector including a housing having at least one electrical terminal mounted therein, a second connector also including a housing and having at least one electrical terminal mounted therein, said first and second connectors configured for mated engagement with one another generally along an axis and for establishing electrical contact between said electrical terminals;

a connector position assurance (CPA) member movably retained in a preassembled position on said first connector prior to engagement of said first and second connectors and said CPA member being transversely movable in relation to said axis from said preassembled position into a second position on said first connector upon proper engagement of said first and second connectors, said CPA member including a main body having a resilient leg extending therefrom, said resilient leg including a first fixed end formed with said main body and a second free end positioned outboard of said main body, said resilient leg having a shoulder formed thereon for preventing movement of said CPA member from said preassembled position into said second position until after proper engagement of said first and second connectors thereby assuring establishment of electrical contact between said electrical terminals of said first and second connectors;

receiving means formed on said first connector for receiving said CPA member in said preassembled position and said second positions, said receiving means including an upright wall cooperating to define a receiving space into which said CPA member is received, a portion of said upright wall interferingly engaging said shoulder to prevent transverse movement of said CPA member from said preassembled position to said second position; and means for disengaging said shoulder from said portion of said upright wall upon proper engagement of said first and second connectors and permitting transverse movement of said CPA member from said preassembled position into said second position, said disengaging means including a projection formed on said second connector, said projection contacting and causing said shoulder to be moved into a non-interferingly position with respect to said portion of said upright wall thereby permitting transverse movement of said CPA member from said preassembled position into said second position.

13. A connector assembly for assuring proper engagement of electrical connectors, said assembly comprising:

a first connector including a housing having at least one electrical terminal mounted therein, a second connector also including a housing and having at least one electrical terminal mounted therein, said first and second connectors configured for mated engagement with one another and for establishing electrical contact between said electrical terminals;

a connector position assurance (CPA) member mountable in a preassembled position relative to said first connector prior to engagement of said first and second connectors and being movable from said preassembled position into a second position relative to said first connector upon proper engagement of said first and second connectors, said CPA member including a main body having a resilient leg extending therefrom, said resilient leg including a first, fixed end formed with said main body, said resilient leg having formed thereon means for preventing movement of said CPA member from said preassembled position in said second position until after proper engagement of said first and second connectors thereby assuring establishment of electrical contact between said electrical terminals of said first and second connectors;

a second leg exteding from said main body, said second leg extending divergently with respect to said resilient leg having a first fixed end formed with said main body and a distal end, a frame extending from said distal end of said second leg and being connected to said main body, said frame cooperating with said second leg to define a central opening through said CPA member, said resilient leg extending into said opening.

* * * * *

UNITED STATES PATENT AND TRADEMARK OFFICE

CERTIFICATE OF CORRECTION

PATENT NO. : 5,257,944

DATED : November 2, 1993

INVENTOR(S) : Robert D. Kennedy

It is certified that error appears in the above-indentified patent and that said Letters Patent is hereby corrected as shown below:

In Column 3, line 51, after "wall" delete "4" and insert --48--.

In Column 4, line 49, after "axis" delete "7" and insert --71--.

In Column 5, line 29, delete "6" and insert --60--.

In Column 5, line 60, after "166", insert --.--.

In Column 9, line 7, Claim 1, after "from" insert --said--.

Signed and Sealed this

Twenty-eighth Day of June, 1994

Bruce Lehman

*Attest:*

BRUCE LEHMAN

*Attesting Officer*

*Commissioner of Patents and Trademarks*